United States Patent [19]

Keller et al.

[11] Patent Number: 4,932,861

[45] Date of Patent: Jun. 12, 1990

[54] PROCESS FOR PREMIXING-TYPE COMBUSTION OF LIQUID FUEL

[75] Inventors: Jakob Keller, Dottikon; Thomas Sattelmayer, Mandach; Daniel Styner, Hallwil, all of Switzerland

[73] Assignee: BBC Brown Boveri AG, Baden, Switzerland

[21] Appl. No.: 282,736

[22] Filed: Dec. 12, 1988

[30] Foreign Application Priority Data

Dec. 21, 1987 [CH] Switzerland ..... 4980/87

[51] Int. Cl.[5] ..... F23C 5/00

[52] U.S. Cl. ..... 431/8; 431/173; 431/284; 431/354

[58] Field of Search ..... 431/2, 8, 173, 182, 431/187, 284, 285, 354; 60/737, 748; 239/290, 399, 403

[56] References Cited

U.S. PATENT DOCUMENTS 1,910,735 5/1933 Zikesch ..... 431/284 X
2,800,093 7/1957 Burg ..... 431/173 X
4,094,625 6/1978 Wang et al. ..... 431/284 X
4,120,640 10/1978 Martin ..... 431/173 X

FOREIGN PATENT DOCUMENTS 0210462 2/1987 European Pat. Off. .

*Primary Examiner*—Randall L. Green
*Attorney, Agent, or Firm*—Burns, Doane, Swecker & Mathis

[57] ABSTRACT

In premixing-type combustion of liquid fuel in a burner without a premixing section, a conical column (5) of liquid fuel is formed in the interior (14) of the burner, which column widens in the direction of flow and is surrounded by a rotating stream (15) of combustion air which flows tangentially into the burner. Ignition of the mixture takes place at the burner outlet, a backflow zone (6) forming in the region of the burner outlet. The burner itself consists of at least two hollow part-cone bodies (1,2) which are superposed on one another and have a cone angle increasing in the direction of flow. The part-cone bodies (1, 2) are mutually offset, so that tangential air inlet slots (19, 20) are formed. A nozzle (3) placed at the burner head ensures injection of the liquid fuel (2) into the interior (14) of the burner.

2 Claims, 2 Drawing Sheets

PROCESS FOR PREMIXING-TYPE COMBUSTION OF LIQUID FUEL

BACKGROUND OF THE INVENTION

1. Field of the Invention

The present invention relates to a process for premixing-type combustion of liquid fuel in a burner without a premixing section, and to a burner for hot-gas generation, consisting of hollow part-cone bodies making up a complete body, having tangential air inlet slots and feed channels for gaseous and liquid fuels.

2. Discussion of Background

European Patent Office Reference No. EP-A1-0,210,462 has disclosed a burner which is formed from at least two double-curved hollow part-cone bodies provided with tangential air entry. These bodies are grooved in the direction of flow along diagonals which diverge outwards in the manner of cone lines. One of the curved grooved sides here forms an inner cone with a cone angle increasing in the downstream direction, whereas the other curved grooved side forms an outer cone with a cone angle decreasing in the downstream direction. The inner cones each carry on the end side, over their entire axial extent, a fuel line for feeding the gaseous fuel which flows through several fuel nozzles into the interior of the burner and is mixed there with the combustion air which flows in tangentially. Moreover, the burner has a separate feed for a liquid fuel, so that this represents a dual burner. The injection of the liquid fuel is directed axially upon the outer cones in such a way that a fuel film of varying lengths forms there, depending on the force of the injection. Apart from the natural vaporisation of the liquid fuel due to the radiant heat acting there, considerable mixing is effected by the tangentially introduced combustion air which, due to its spinning motion, unrolls the fuel film layer-wise in the axial direction, so that generation of intensive mixing becomes superfluous. Due to the fact that the momentum of the injection of liquid fuel is adapted to the load of the machine, the mixture is never too lean or too rich.

Two goals can be achieved directly in this way:

The advantages of a premixing burner, namely little $NO_x$ and CO, are obtained.

Good flame stability in a fairly wide operating range is ensured.

Moreover, the constructional design of this burner results in a vortex flow with a low spin in the centre but an excess of axial velocity. Because the spin coefficient then sharply increases in the axial direction and, at the end of the burner, reaches the breakdown value or critical value, the result is a position-stable vortex backflow.

Even though the advantages of the burner described here cannot be denied, it has nevertheless been found that the $NO_x$ and CO emission values, even though they are, as a result of using the burner, already lower than the statutory limits, must be substantially reduced in future. Moreover, it has also been found that coking problems of the outer cone resulting from the combustion of oil cannot be excluded, and the fuel injection is not easy to handle.

Furthermore, the arrangement for the oil injection is relatively complicated constructionally. However, the feeding of the grooved cone sections and their mutual matching are not easy to handle.

SUMMARY OF THE INVENTION

Accordingly, one object of the invention, as it is defined in the claims, is to provide, in a process and in a burner of the types described at the outset, a simplified bodily design of the burner and at the same time to minimize the $NO_x$ emission values from the premixing-type combustion of liquid fuel, without altering the flow field in the burner with the stable vortex backflow zone.

The essential advantages of the invention with respect to the design are to be seen in the fact that the absence of the otherwise usual premixing zone does not cause any risk of flashback into the burner. Moreover, the well known problems in the use of spin generators in the mixture stream, for example those shortcomings which are caused by burning off coatings with destruction of the spin blades, disappear.

The essential advantage of the invention with respect to the $NO_x$ emission values is to be seen in the fact that these abruptly fall to a fraction of what has hitherto been regarded as the best achievable. The improvement thus comprises not just a few percentage points, but leads now to the order of magnitude of a vanishingly small 10–15% of the statutory limits, so that an entirely new quality level is reached. A further advantage of the invention results from the suitability of the burner according to the invention for use also in gas turbines, where the pressure ratio—more than about 12—is so high that prevaporization of the liquid fuel is fundamentally no longer possible because it will be preceded by self-ignition of the fuel. Finally, the burner according to the invention can also still be used in those cases where the feasible air preheating would be insufficient for vaporization or is impossible.

Not last, it is also an essential advantage of the invention that the burner according to the invention consists of a few components which are simple to manufacture and assemble.

Advantages and expedient further developments of the achievement of the object according to the invention are defined in the dependent claims.

An illustrative embodiment of the invention is explained below by reference to the drawing. All the elements not required for the direct appreciation of the invention have been omitted. The directions of flow of the various media are indicated by arrows.

BRIEF DESCRIPTION OF THE DRAWINGS

More complete appreciation of the invention and many of the appendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
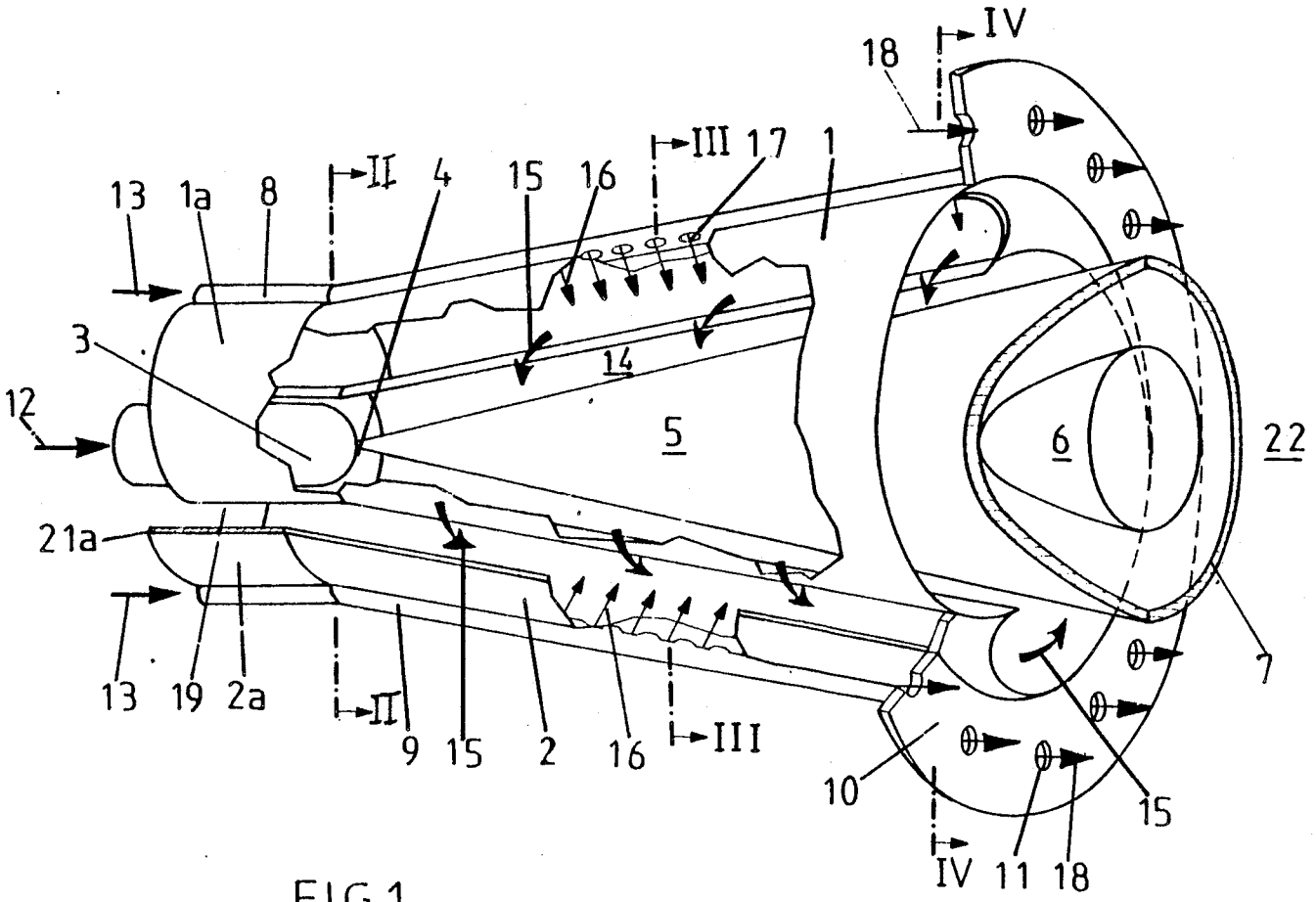
FIG. 1 shows a burner in perspective illustration, appropriately cut open.
Figure 2:
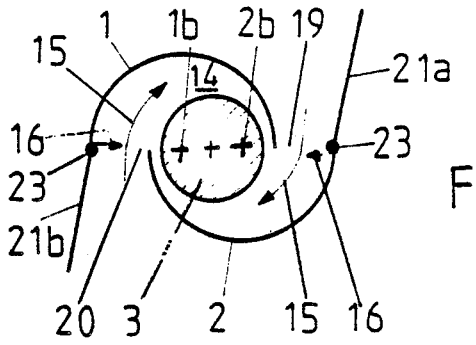
FIGS. 2, 3 and 4 show corresponding sections through the planes II—II (FIG. 2), III—III (FIG. 3) and IV—IV (FIG. 4), these sections being only a diagrammatic simplified illustration of the burner.
Figure 3:
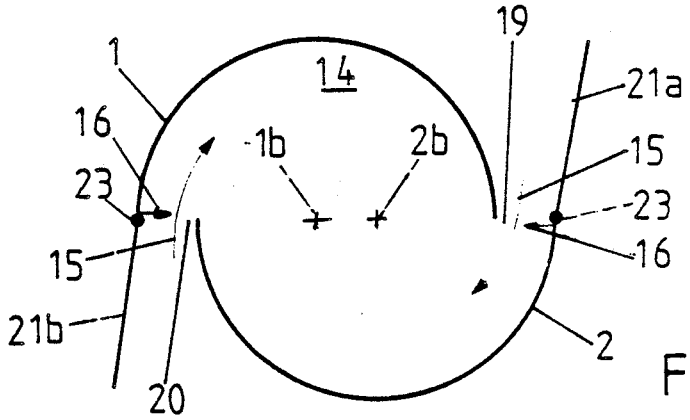
Figure 4:
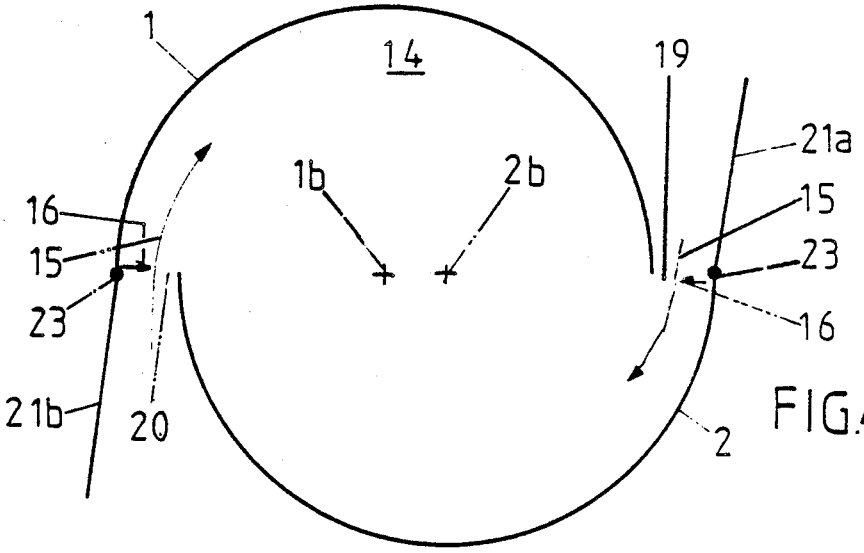

Referring now to the drawings, wherein like reference numerals designate identical or corresponding paths throughout the several views in FIGS. 1–4, it is of advantage to the reader, for a better understanding of the structure of the burner, to consider the individual sections according to FIGS. 2–4 simultaneously with FIG. 1. Furthermore, in order to avoid unnecessary complexity of FIG. 1, the baffles 21*a*, 21*b* shown diagrammatically in FIGS. 2–4 are only included by way of indication in FIG. 1. Reference is also made below selectively, as required, to the remaining FIGS. 2–4 in the description of FIG. 1.

The burner according to FIG. 1 consists of two half hollow part-cone bodies 1, 2 which are superposed on one another with a mutual offset. The offset of the particular center axis 1*b*, 2*b* of the part-cone bodies 1, 2 relative to one another provides on each of the two sides in a mirror-image arrangement a free tangential air inlet slot 19, 20 (FIGS. 2–4), through which the combustion air 15 flows into the interior of the burner, i.e. into the conical cavity 14. The two part-cone bodies 1, 2 each have a cylindrical initial part 1*a*, 2*a*, which likewise extend at a mutual offset analogously to the part-cone bodies 1, 2, so that the tangential air inlet slots 19, 20 are present right from the start. In this cylindrical initial part 1*a*, 2*a*, a nozzle 3 is accommodated, the fuel injection 4 of which coincides with the narrowest cross-section of the conical cavity 14 formed by the two part-cone bodies 1, 2. Of course, the burner can also be of purely conical design, that is to say without cylindrical initial parts 1*a*, 2*a*. The two part-cone bodies 1, 2 each have one fuel line 8, 9 which are provided with orifices 17, through which the gaseous fuel 13 is admixed to the combustion air 15 flowing through the tangential air inlet slots 19, 20. The position of these fuel lines 8, 9 can be seen diagrammatically from FIGS. 2–4: the fuel lines 8, 9 are fitted at the end of the tangential air inlet slots 19, 20, so that the admixture 16 of the gaseous fuel 13 to the combustion air 15 flowing in also takes place at that point. On the combustion chamber side 22, the burner has a collar-shaped end plate 10 which serves as an anchorage for the part-cone bodies 1, 2 and has a number of bores 11, through which dilution air or cooling air 18 can, if necessary, be fed to the front part of the combustion chamber 22 or to the wall thereof. The liquid fuel 12 flowing through the nozzle 3 is injected under an acute angle into the conical cavity 14 in such a way that a conical fuel spray, which is as homogeneous as possible, is established in the burner outlet plane, it being necessary strictly to ensure that the inner walls of the part-cone bodies 1, 2 are not wetted by the injected liquid fuel 12. The fuel injection 4 can be an air-assisted nozzle or a pressure atomizer. The conical liquid fuel profile 5 is surrounded by a rotating combustion air stream 15 flowing in tangentially. In the axial direction, the concentration of the liquid fuel 12 is continuously reduced by the admixed combustion air 15. When gaseous fuel 13/16 is burned, formation of the mixture with the combustion air 15 takes place directly at the end of the air inlet slots 19, 20. When liquid fuel 12 is injected, the homogeneous optimum fuel concentration over the cross-section is reached in the region of the vortex breakdown, that is to say in the region of the backflow zone 6. Ignition takes place at the apex of the backflow zone 6. It is only at this point that a stable flame front 7 can form. Flashback of the flame into the interior of the burner, as is latently the case with premixing sections, where a remedy is sought by means of complicated flame retention baffles, is not to be feared here. If the combustion air 15 is preheated, natural vaporization of the liquid fuel 12 is established before that point at the burner outlet is reached where ignition of the mixture can take place. The degree of vaporization depends of course on the size of the burner, on the droplet size distribution and on the temperature of the combustion air 15. However, independently of whether, apart from the homogeneous droplet premixing by combustion air 15 of low temperature or additionally, only partial or complete droplet vaporization is achieved by preheated combustion air 15, the resulting nitrogen oxide and carbon monoxide emissions are low if the air excess is at least 60%. The pollutant emission values are lowest in the case of complete vaporization before entry into the combustion zone. The same also applies to near-stoichiometric operation, if the excess air is replaced by recirculating off-gas. In the design of the part-cone bodies 1, 2, it is necessary to adhere to narrow limits with respect to cone angle and the width of the tangential air inlet slots 19, 20, in order to ensure that the desired flow field of the air with its backflow zone 6 is established for flame stabilization in the region of the burner outlet. Generally, it can be said that a reduction of the air inlet slots 19, 20 displaces the backflow zone 6 further upstream, whereby, however, the mixture would then reach ignition at an earlier point. Nevertheless, it can be said here that the backflow zone 6 once fixed geometrically is then in itself position-stable, since the spin coefficient increases in the direction of flow in the region of the conical shape of the burner. The design of the burner is outstandingly suitable, with a given overall length of the burner, for varying the size of the tangential air inlet slots 19, 20, since the part-cone bodies 1, 2 are fixed to the end plate 10 by means of a releasable connection. By radial displacement of the two part-cone bodies 1, 2 towards or away from each other, the distance between the two centre axes 1*b*, 2*b* is, respectively, decreased or increased, and the gap size of the tangential air inlet slots 19, 20 changes correspondingly, as can be seen particularly clearly from FIGS. 2–4. Of course, the part-cone bodies 1, 2 are also displaceable relative to one another in another plane, so that even an overlap thereof can be approached in this way. Indeed, it is even possible to displace the part-cone bodies 1, 2 spirally within one another by a rotary movement in opposite directions. There is thus a facility for varying the shape and size of the tangential air inlets 19, 20 as desired, so that the burner is suitable for universal use without a change in its overall length.

FIGS. 2–4 also show the position of the baffles 21*a*, 21*b*. They have flow-inducing functions and, with their different lengths, they extend the particular end of the part-cone bodies 1 and 2 in the inflow direction of the combustion air 15. The channelling of the combustion air into the conical cavity 14 can be optimized by opening and closing the baffles 21*a*, 21*b* about the pivot point 23, which is necessary especially if the original gap size of the tangential air inlet slots 19, 20 is altered.

Obviously, numerous modifications and variations of the present invention are possible in the light of the above teachings. It is therefore to be understood that, within the scope of the appended claims, the invention may be practiced otherwise than as specifically described herein.

What is claimed as new and desired to be secured by Letters Patent of the United States is:

1. A process for premixing-type combustion of liquid fuel in a burner in the absence of a premixing section, which comprises forming, in the interior of the burner, a conical column of liquid fuel, which widens in the direction of flow and does not wet the walls of the interior and which is surrounded by a rotating stream of combustion air introduced substantially continuously along the length of said burner and which flows tangentially into the burner, ignition of the mixture starting at the burner outlet, and flame stabilization in the region of the burner outlet being achieved by means of a backflow zone.

2. A process as claimed in claim 1, wherein gaseous fuel is fed to the combustion air stream before the latter flows into the interior of the burner.

* * * * *